US009144983B2

(12) United States Patent
Gengrinovich et al.

(10) Patent No.: US 9,144,983 B2
(45) Date of Patent: Sep. 29, 2015

(54) FIN MEMBERS TO GUIDE FLUID

(75) Inventors: Semion Gengrinovich, Ramat Gan (IL); Ran Vilk, Qiryat Ono (IL); Gil Fisher, Shoham (IL)

(73) Assignee: Hewlett-Packard Industrial Printing LTD., Netanya (IL)

( * ) Notice: Subject to any disclaimer, the term of this patent is extended or adjusted under 35 U.S.C. 154(b) by 0 days.

(21) Appl. No.: 14/371,151

(22) PCT Filed: Jan. 18, 2012

(86) PCT No.: PCT/IL2012/000026
§ 371 (c)(1),
(2), (4) Date: Jul. 8, 2014

(87) PCT Pub. No.: WO2013/108240
PCT Pub. Date: Jul. 25, 2013

(65) Prior Publication Data

US 2014/0375732 A1 Dec. 25, 2014

(51) Int. Cl.
*B41J 2/175* (2006.01)
*B41J 2/18* (2006.01)

(52) U.S. Cl.
CPC .. *B41J 2/175* (2013.01); *B41J 2/18* (2013.01); *B41J 2202/12* (2013.01); *B41J 2202/20* (2013.01)

(58) Field of Classification Search
CPC ..... B41J 2202/20
USPC ..... 347/40
See application file for complete search history.

(56) References Cited

U.S. PATENT DOCUMENTS

| | | | | |
|---|---|---|---|---|
| 4,658,272 | A * | 4/1987 | Toganoh et al. | 347/42 |
| 6,276,778 | B1 | 8/2001 | Katayama | |
| 6,679,597 | B2 | 1/2004 | Ohsawa et al. | |
| 6,942,815 | B2 | 9/2005 | Umehara | |
| 7,158,719 | B2 * | 1/2007 | Cassidy | 392/494 |
| 2005/0259127 | A1 | 11/2005 | Enomoto et al. | |
| 2006/0284931 | A1 * | 12/2006 | Blair et al. | 347/54 |
| 2007/0139468 | A1 * | 6/2007 | Schulmeister | 347/40 |

FOREIGN PATENT DOCUMENTS

| | | | |
|---|---|---|---|
| EP | 0666174 | A2 | 8/1995 |
| GB | 2433232 | A | 6/2007 |
| JP | 2003260797 | A | 9/2003 |
| JP | 2008100470 | A | 5/2008 |
| JP | 2008-188963 | A | 8/2008 |
| JP | 2011110850 | A | 6/2011 |

* cited by examiner

*Primary Examiner* — Stephen Meier
*Assistant Examiner* — John P Zimmermann
(74) *Attorney, Agent, or Firm* — Van Cott, Bagley, Cornwall & McCarthy

(57) ABSTRACT

A fluid applicator mounting device includes a main body to removeably receive a fluid applicator module. The main body includes a common fluid channel having a main input port, a main output port, a supplemental input port to provide fluid to the fluid applicator module, and a supplemental output port to output fluid from the fluid applicator module. The fluid applicator mounting device also includes an input fm member disposed inside the common fluid channel and arranged proximate to the supplemental input port to guide fluid to the fluid applicator module. The fluid applicator mounting device also includes an output fin member disposed inside the common fluid channel and arranged proximate to the supplemental output port to guide fluid from the fluid applicator module away from the supplemental output port.

20 Claims, 9 Drawing Sheets

FIN MEMBERS TO GUIDE FLUID

BACKGROUND

Fluid applicator mounting devices may removeably receive fluid applicator modules. The fluid applicator modules may selectively apply fluid to an object. The fluid applicator mounting device may include a common supply channel to supply fluid to the fluid applicator modules. The fluid applicator modules may include printhead modules, or the like.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components, layers, substrates and features illustrated in the figures are chosen primarily for convenience and clarity of presentation and are not necessarily to scale. Referring to the attached figures:

DETAILED DESCRIPTION

Fluid applicator mounting devices may removeably receive fluid applicator modules. The fluid applicator modules may selectively apply fluid to an object. The fluid applicator mounting device may include a channel to supply fluid to the fluid applicator modules. The fluid applicator modules may include printhead modules, or the like. Fluid such as pigmented ink having solid pigment particles may be supplied, for example, to an array of inkjet printhead modules removeably mounted on the fluid applicator mounting device. As pigment particles may tend to precipitate and agglomerate, the pigmented ink may be continuously supplied to the fluid applicator modules to stir the pigmented ink. However, a large amount of pigment ink may remain in the fluid applicator modules without being recirculated out and in thereof (e.g., refreshed). Thus, pigmented particles may precipitate within the fluid applicator modules, obstruct fluid delivery and cause nozzle malfunction resulting in reducing performance of the fluid applicator modules.

In examples, a fluid applicator mounting device includes, among other things, a main input port, a main output port, an input fin member, and an output fin member disposed in a common fluid channel. The main input port may receive fluid from the fluid reservoir. The input fin member may be arranged proximate to a supplemental input port to guide fluid to a respective fluid applicator module. The output fin member may be arranged proximate to a supplemental output port to guide fluid from the respective fluid applicator module away from the supplemental output port. The main output port may output fluid from the common fluid channel to be returned to the fluid reservoir. Respective fin members to direct fluid into and out of the fluid applicator modules may reduce the amount of fluid remaining in the fluid applicator modules without being refreshed. Consequently, undesirable precipitation of fluid within the fluid applicator modules, obstruction of fluid delivery, and nozzle malfunction may be reduced.

Figure 1:
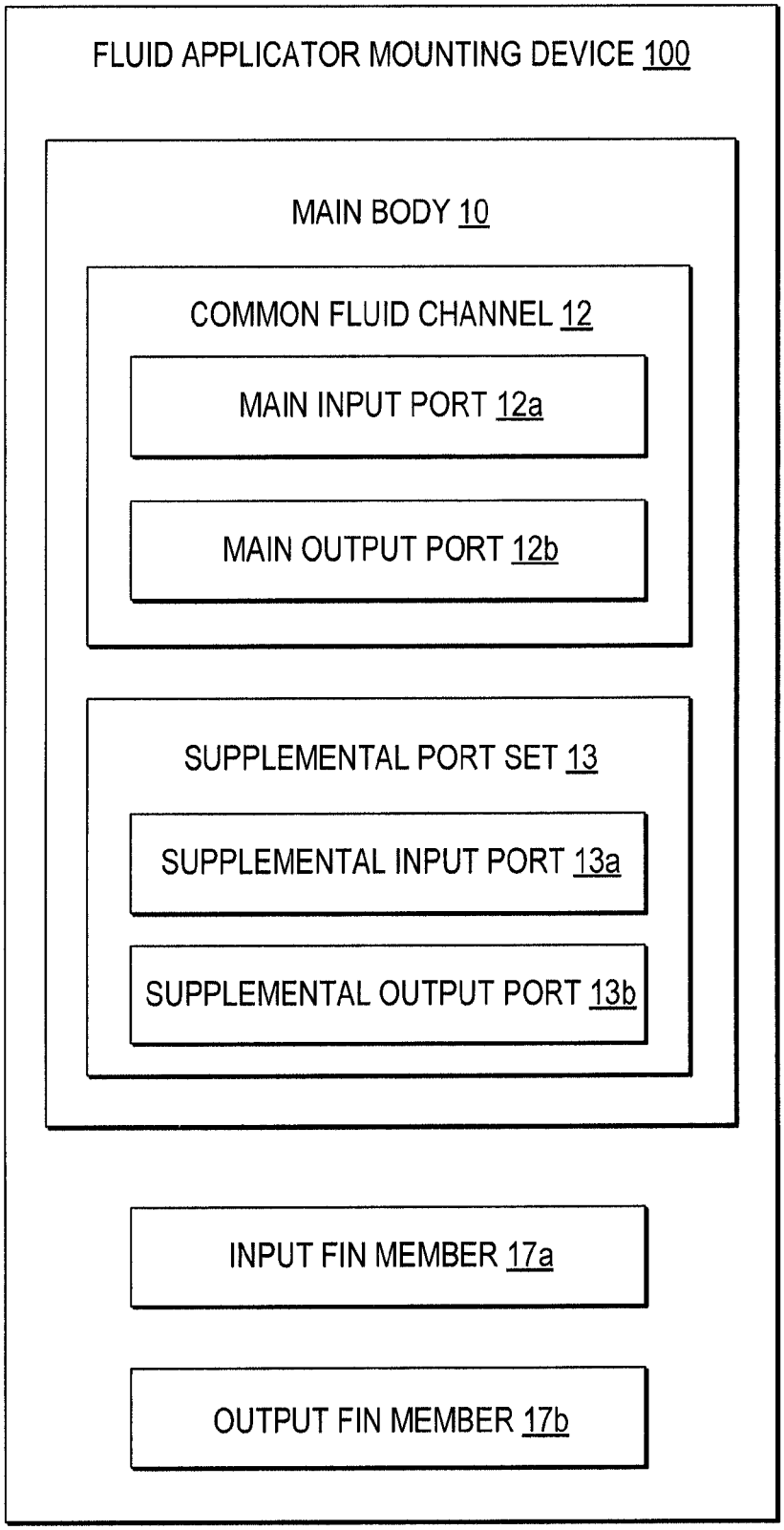
FIG. 1 is a block diagram illustrating a fluid applicator mounting device according to an example.

FIG. 1 is a block diagram illustrating a fluid applicator mounting device according to an example. Referring to FIG. 1, in some examples, a fluid applicator mounting device 100 includes a main body 10 to removeably receive a fluid applicator module 60*a* (FIG. 2), an input fin member 17*a* , and an output fin member 18*a* . The main body 10 may include a common fluid channel 12 extending therein, and a supplemental port set 13. The supplemental port set 13 may include a supplemental input port 13*a* and a supplemental output port 13*b* corresponding to a respective fluid applicator module 60*a* . The common fluid channel 12 may include a main input port 12*a* to receive fluid from a fluid reservoir and a main output port 12*b* to return fluid to the fluid reservoir. The supplemental input port 13*a* may provide fluid from the common fluid channel 12 to the fluid applicator module 60*a* . The supplemental output port 13*b* may output fluid from the fluid applicator module 60*a* to the common fluid channel 12.

Referring to FIG. 1, in some examples, the input fin member may be disposed inside the common fluid channel 12 and arranged proximate to the supplemental input port 13*a* to guide fluid to the fluid applicator module 60*a* . The output fin member 18*a* may be disposed inside the common fluid channel 12 and arranged proximate to the supplemental output port 13*b* to guide fluid from the fluid applicator module 60*a* away from the supplemental output port 13*b* . That is, the fluid may be directed into the common fluid channel 12 to be subsequently output through the main output port 12*b* from the common fluid channel 12.

Figure 2:
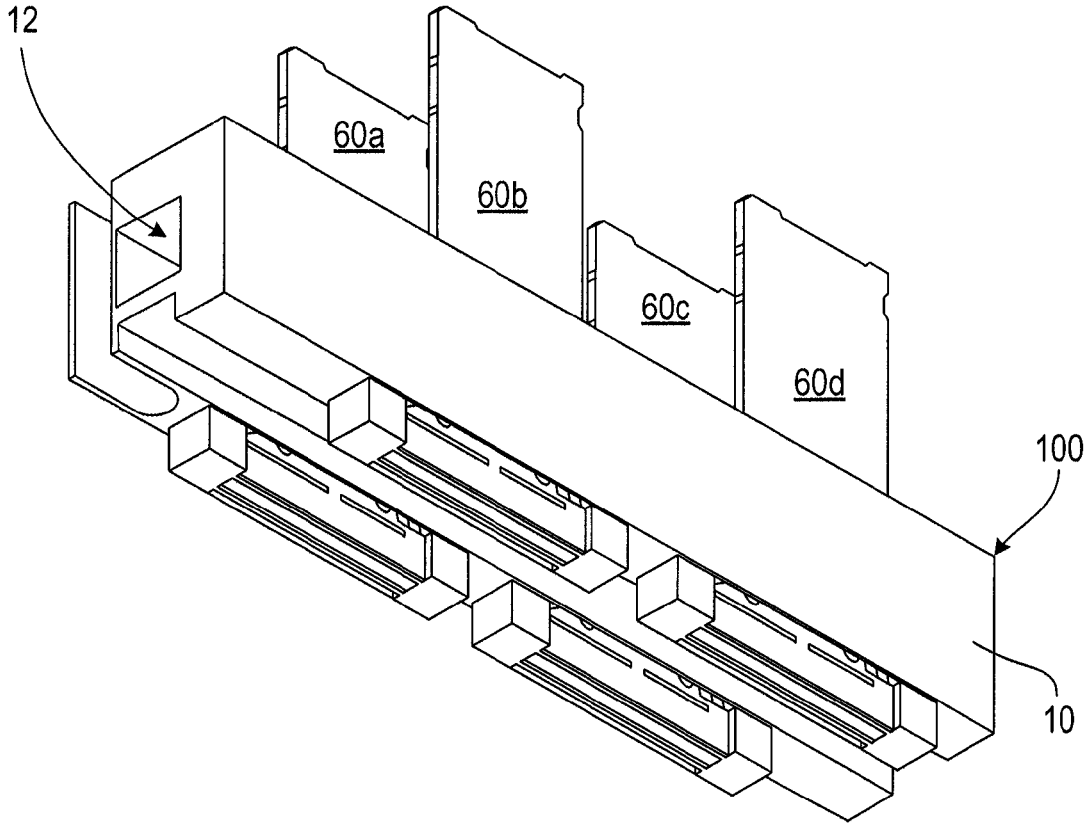
FIG. 2 is a perspective view illustrating the fluid applicator mounting device of FIG. 1 with fluid applicator modules mounted thereto according to an example.
Figure 3:
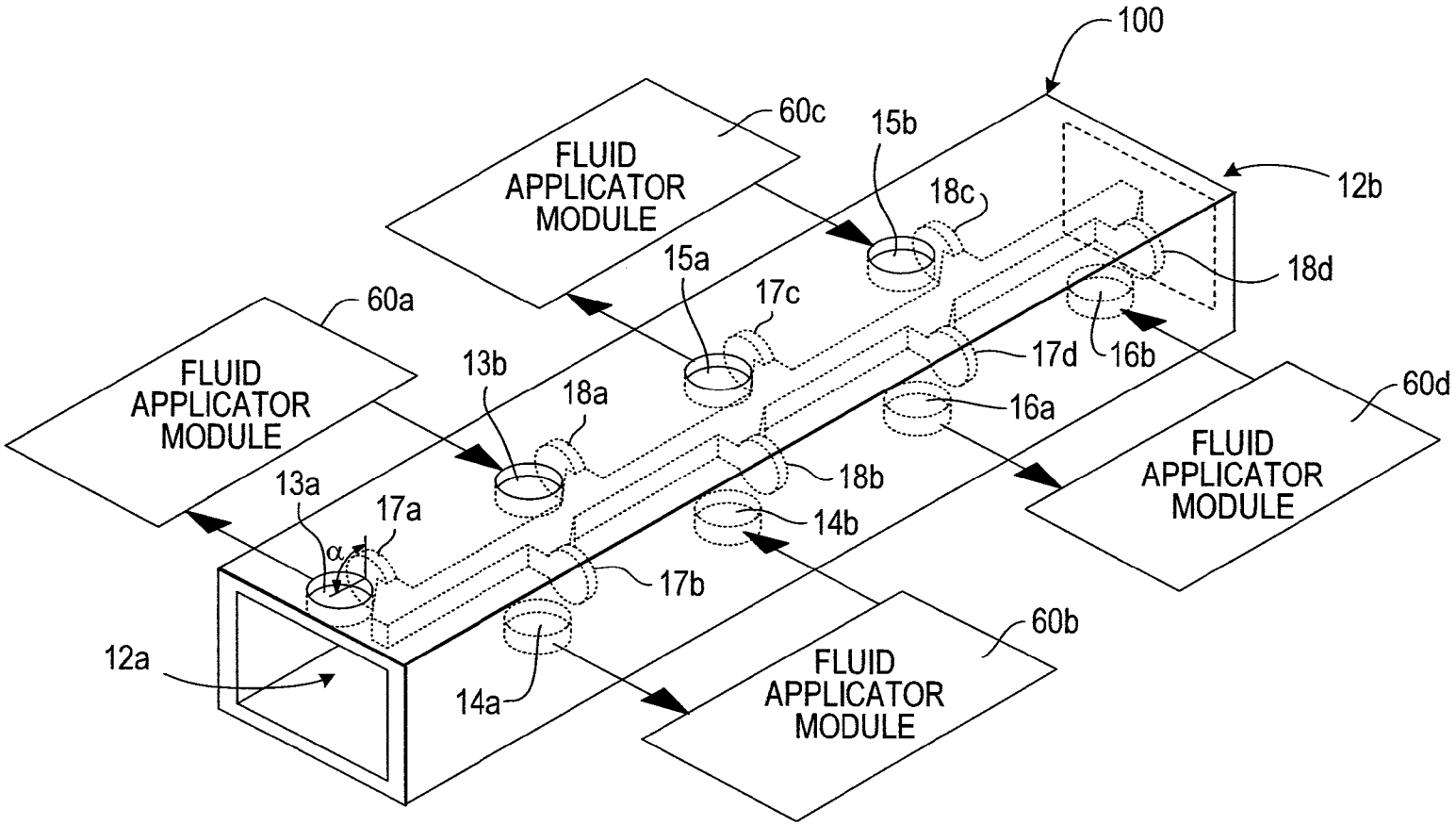
FIG. 3 is a schematic view illustrating the common fluid channel of the fluid applicator mounting device of FIG. 2 in communication with fluid applicator modules according to an example.
Figure 4:
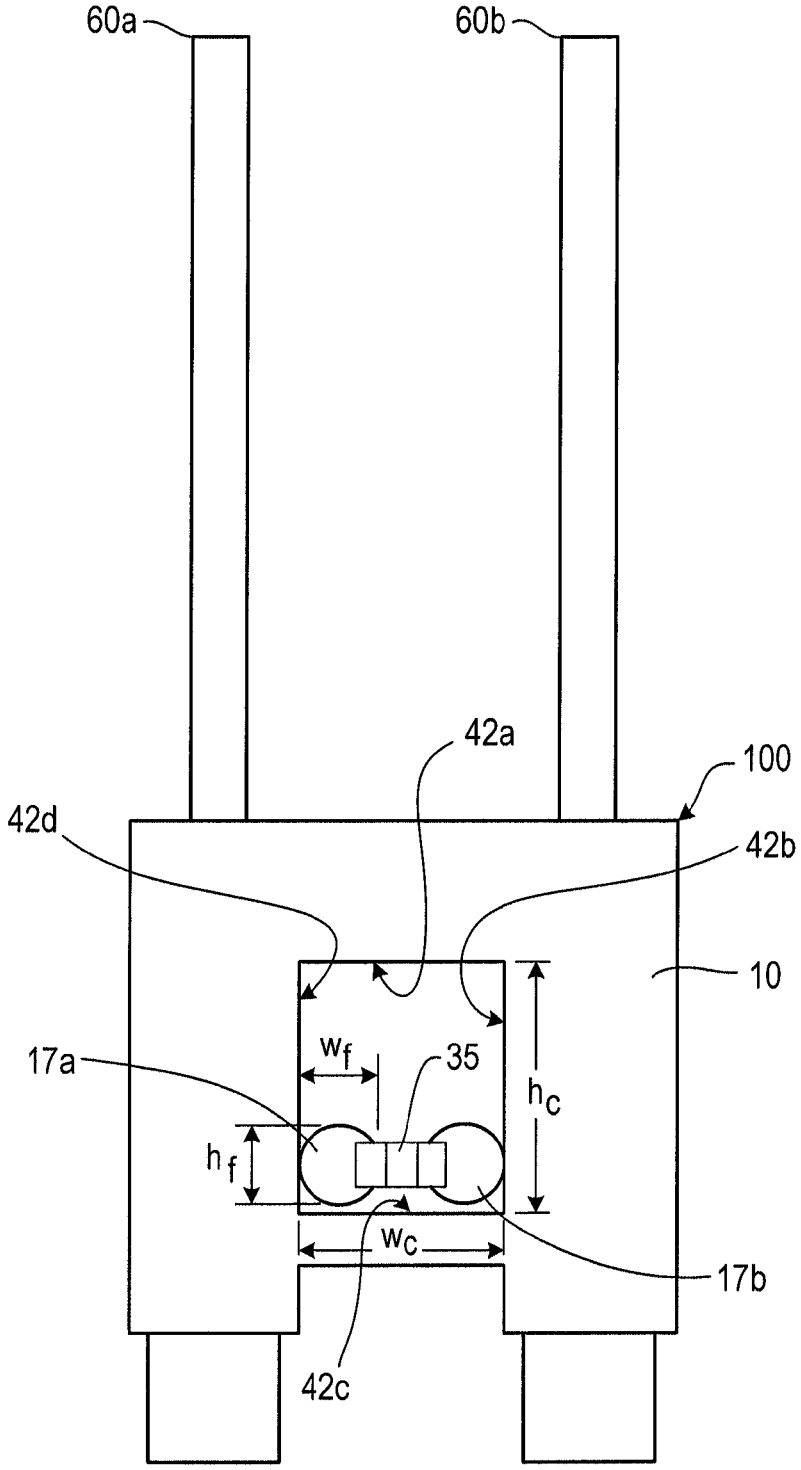
FIG. 4 is a cross-sectional view illustrating the fluid applicator mounting device of FIG. 2 according to an example.

FIG. 2 is a perspective view illustrating the fluid applicator mounting device of FIG. 1 with fluid applicator modules mounted thereto according to an example. FIG. 3 is a schematic view illustrating the common fluid channel of the fluid applicator mounting device of FIG. 2 in communication with fluid applicator modules according to an example. FIG. 4 is a cross-sectional view illustrating the fluid applicator mounting device of FIG. 2 according to an example. Referring to FIGS. 2-4, in some examples, a fluid applicator mounting device 100 may include a common fluid channel 12 including a plurality of walls 42*a* , 42*b* , 42*c* and 42*d* intersecting with each other. The common fluid channel 12 may also include a channel height $h_c$ and a channel width $w_c$. That is, the channel height $h_c$ and the channel width $w_c$ may correspond to a cross-sectional space of the common fluid channel 12 for fluid to flow there through. The shape of the common fluid channel 12 may be substantially rectangular, or the like. In some examples, the fluid may be a pigmented fluid such as pigmented ink.

In some examples, the fluid applicator module 60*a* may be a printhead module, or the like. For example, the fluid applicator module 60*a* may include an inkjet printhead module. The inkjet printhead module may include a silicon micromachined chip, or the like. In some examples, a large format printing system may include printhead arrays including a plurality of inkjet printhead modules mounted to the fluid applicator mounting device 100 and extending across a media transport path.

Referring to FIGS. 3 and 4, in some examples, the input fin member 17*a* and the output fin member 18*a* may have a fin height $h_f$ less than the channel height $h_c$ and a fin width $w_f$ less than the channel width $w_c$. A shape of the input fin member 17*a* and the output fin member 18*a* may be substantially circular, substantially rectangular, or the like. In some examples, the input fin member 17*a* and the output fin member 18*a* may be arranged substantially perpendicular to at least one of the walls 42*a* , 42*b* , 42*c* , and 42*d* . For example, the input fin member 17*a* and the output fin member 18*a* may be substantially perpendicular to a wall 42*c* in which the supplemental input port 13*a* and the supplemental output port 13*b* are disposed. That is, each one of the respective fin members 17*a* and 18*a* may form an angle $\alpha$ of substantially ninety degrees with the respective wall 42*c* . In some examples, the input fin member 17*a* and the output fin member 18*a* are substantially perpendicular to each one of the walls 42*a* , 42*b* , 42*c* , and 42*d* . In some examples, the main body 10 may include a plurality of supplemental input ports 13*a* , 14*a* , 15*a* , and 16*a* and a plurality of supplemental output ports 13*b* , 14*b* , 15*b* , and 16*b*.

Figure 5:
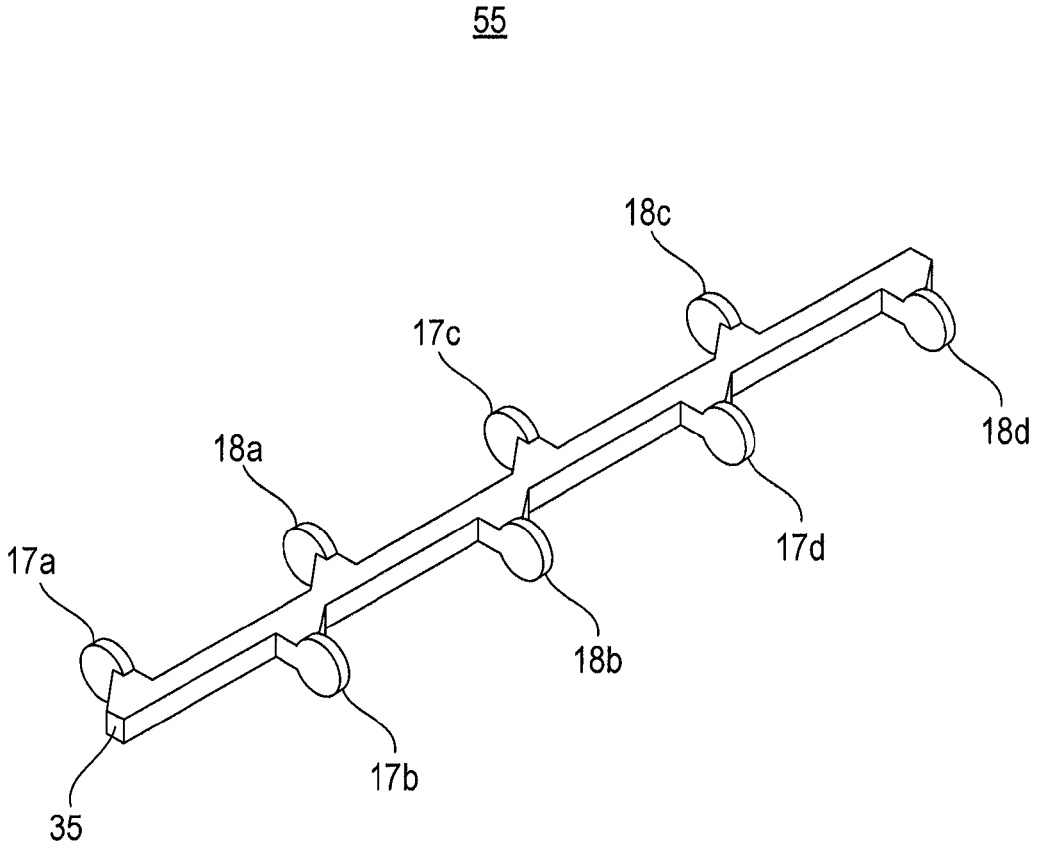
FIG. 5 is a perspective view illustrating a single fin unit of the fluid applicator mounting device of FIG. 2 according to an example.

FIG. 5 is a perspective view illustrating a single fin unit of the fluid applicator mounting device of FIG. 2 according to an example. Referring to FIG. 5, a fluid applicator mounting device 100 may also include a single fin unit 55. The single fin unit 55 may include a fin carrier member 35, an input fin member 17*a* , and an output fin member 18*a* . The input fin member 17*a* and the output fin member 18*a* may be coupled to the fin carrier member 35 and extend outward $d_o$ there from. The fin carrier member 35 may include a plurality of input fin members 17*a* , 17*b* , 17*c* , and 17*d* and output fin members 18*a* , 18*b*, 18*c* , and 18*d* coupled thereto. For example, the plurality of input fin members 17*a* , 17*b* , 17*c* , and 17*d* and output fin members 18*a* , 18*b* , 18*c* , and 18*d* may be arranged proximate to corresponding supplemental input ports 13*a* , 14*a* , 15*a*, and 16*a* and supplemental output ports 13*b* , 14*b* , 15*b* , and 16*b* . In some examples, the respective fin members 17*a*-18*b* may be adjusted and on a downstream side with respect to the fluid flow in the common fluid channel 12 of the corresponding supplemental ports 13*a*-16*b* . The single fin unit 55 may be removeably disposed inside the common fluid channel 12.

Figure 6:
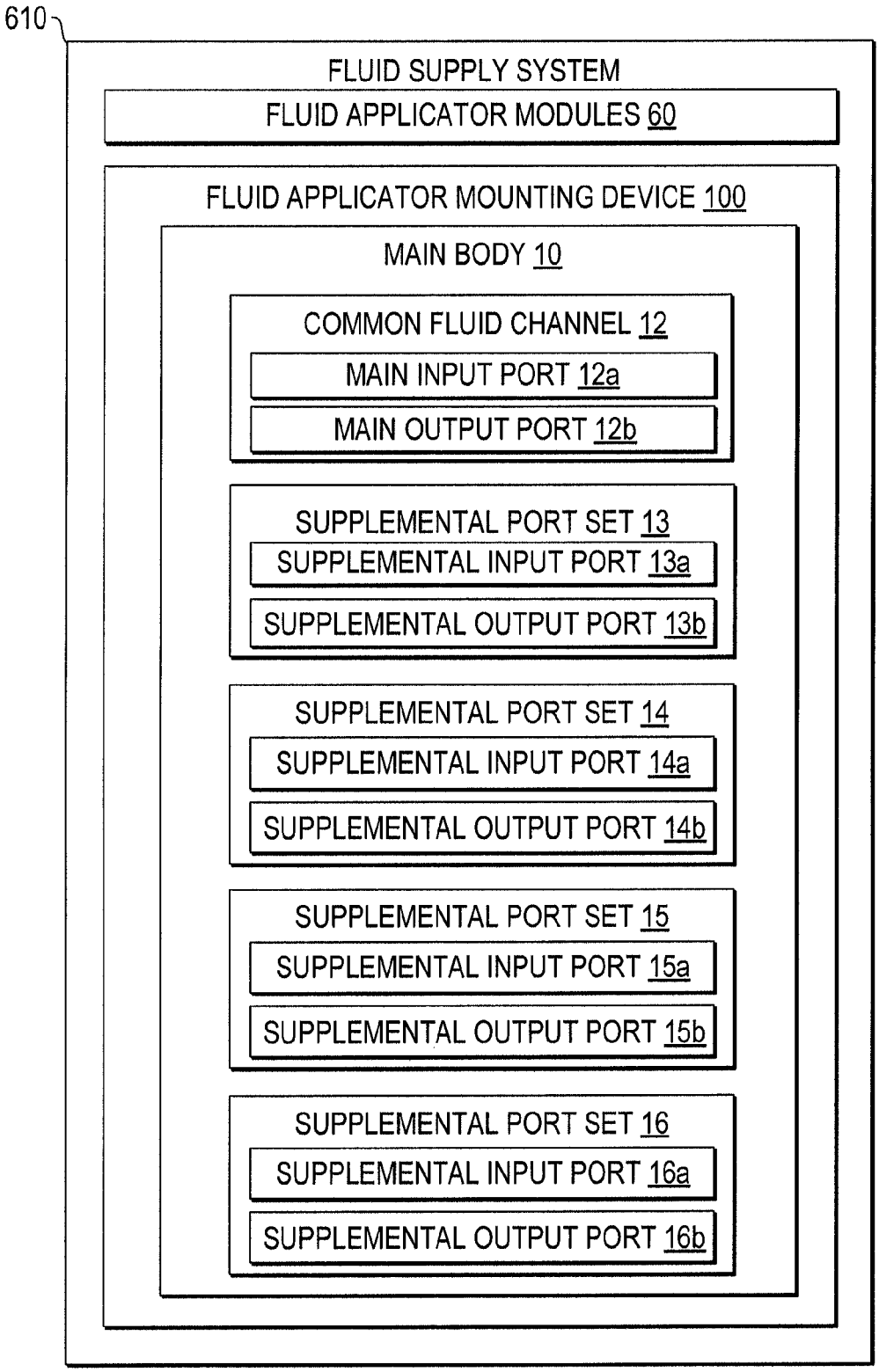
FIG. 6 is a block diagram illustrating a fluid supply system to supply fluid to fluid applicator modules according to an example.

FIG. 6 is a block diagram illustrating a fluid supply system to supply fluid to fluid applicator modules according to an example. Referring to FIG. 6, in some examples, a fluid supply system 610 may include fluid applicator modules 60 to apply fluid onto objects such as media and a fluid applicator mounting device 100 to receive the fluid applicator modules 60. The fluid applicator mounting device 100 may include a main body 10 including a common fluid channel 12 therein, supplemental port sets 13, 14, 15, and 16, input fin members 17, and output fin members 18. The common fluid channel 12 may include a main input port 12*a* to receive fluid from a fluid reservoir and a main output port 12*b* to return fluid to the fluid reservoir. The supplemental port sets 13, 14, 15, and 16 may correspond to the fluid applicator modules 60, respectively. Each supplemental port set 13 may include a supplemental input port 13*a* to provide fluid to the corresponding fluid applicator module 60*a* and a supplemental output port 13*b* to output fluid from the corresponding fluid applicator module 60*a*.

Referring to FIG. 6, in some examples, the input fin members 17 and the output fin members 18 may be disposed in the common fluid channel 12. Each input fin member 17 may be arranged proximate to a corresponding supplemental input port 13*a* , 14*a* , 15*a* , and 16*a* to guide fluid to the respective fluid applicator module 60. Each output fin member 18 may be arranged proximate to a corresponding supplemental output port 13*b* , 14*b* , 15*b*, and 16*b* to guide fluid from the respective fluid applicator module 60 away from the corresponding supplemental output port 13*b* , 14*b* , 15*b* , and 16*b* . That is, the fluid may be directed into the common fluid channel 12 to be subsequently output through the main output port 12*b* from the common fluid channel 12.

In some examples, the fluid applicator mounting device 100 of FIG. 6 may correspond to the fluid applicator mounting device 100 previously disclosed with respect to FIGS. 1-5. For example, the common fluid channel 12 may include a plurality of walls 42*a* , 42*b* , 42*c* , and 42*d* intersecting with each other to form the common fluid channel 12 having a channel height $h_c$ and a channel width $w_c$. The fluid supply system 610 may also include a fin carrier member 35 coupled to the input fin members 17 and the output fin members 18 extending outward $d_o$ from the fin carrier member 35 to form a single fin unit 55. The single fin unit 55 may be removeably disposed inside the common fluid channel 12. The input fin members 17 and the output fin members 18 may have a fin height $h_f$ less than the channel height $h_c$ and a fin width $w_f$ less than the channel width $w_c$. A shape of the input fin members 17 and the output fin members 18 may be at least one of substantially circular and substantially rectangular. The input fin members 17 and the output fin members 18 may be arranged substantially perpendicular to at least one of the walls 42*a* , 42*b* , 42*c*, and 42*d* . For example, the input fin members 17 and the output fin members 18 may be substantially perpendicular to a wall 42*c* in which the supplemental input ports 13*a* , 14*a* , 15*a* , and 16*a* and the supplemental output ports 13*b* , 14*b* , 15*b*, and 16*b* are disposed. In some examples, the input fin members 17 and the output fin members 18 are substantially perpendicular to each one of the walls 42*a* , 42*b* , 42*c* , and 42*d*.

Figure 7:
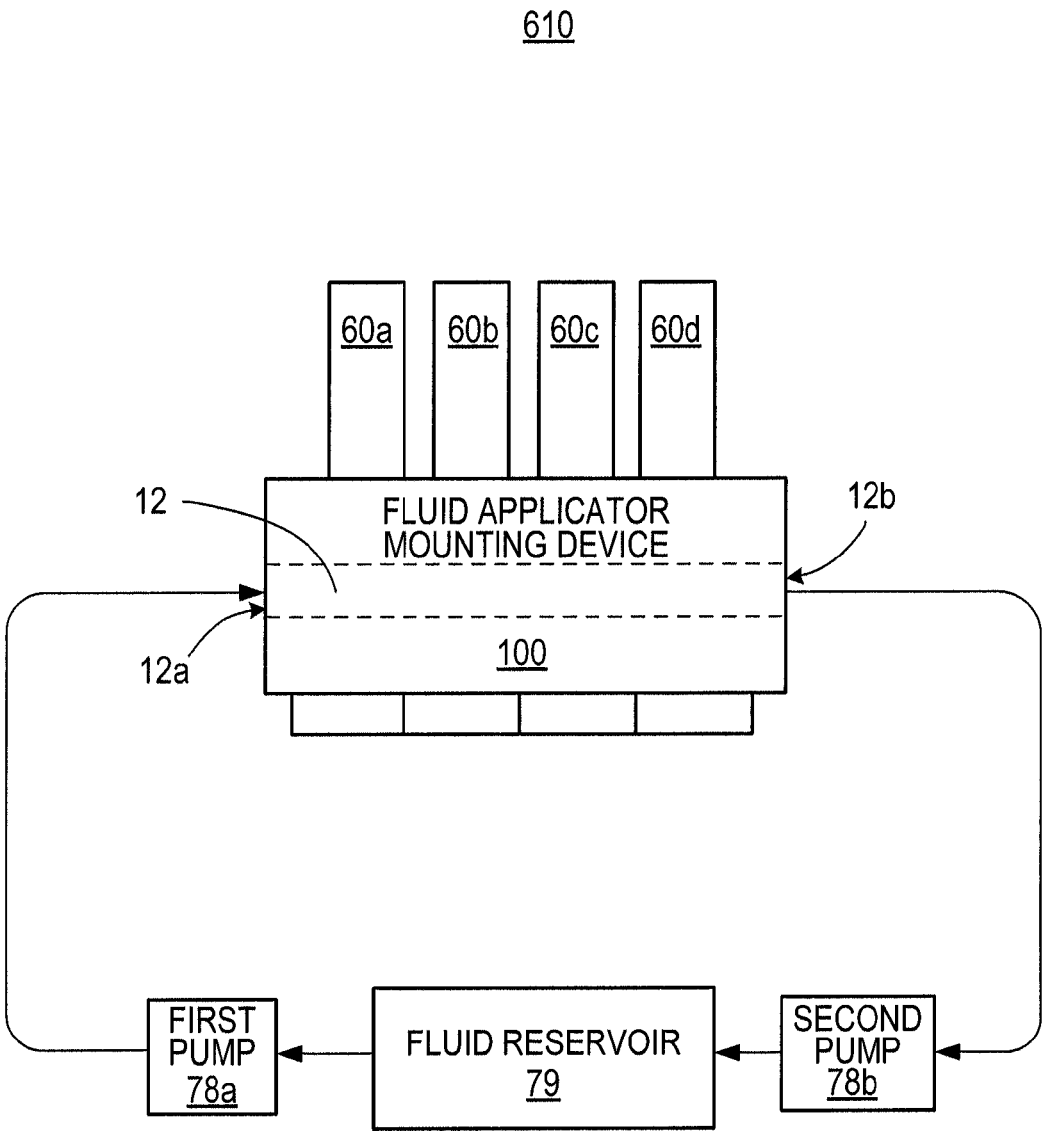
FIG. 7 is a schematic diagram illustrating the fluid supply system of FIG. 6 according to an example.

FIG. 7 is a schematic diagram illustrating the fluid supply system of FIG. 6 according to an example. Referring to FIG. 7, a fluid supply system 610 may also include at least one pump 78*a* and 78*b* to transport fluid between a fluid reservoir 79 and the fluid applicator modules 60*a* , 60*b* , 60*c* , and 60*d* . For example, a first pump 78*a* may be disposed between the fluid reservoir 79 and the fluid applicator mounting device 100 to pump fluid from the fluid reservoir 79 to the fluid applicator mounting device 100. That is, fluid may be transported from the fluid reservoir 79 through the first pump 78*a* to the main input port 12*a* of the common fluid channel 12 of the fluid applicator mounting device 100. Additionally, a second pump 78*b* may be disposed between the fluid reservoir 79 and the fluid applicator mounting device 100 to pump fluid from the fluid applicator mounting device 100 to the fluid reservoir 79. That is, fluid is transported from the main output port 12*b* of the common fluid channel 12 of the fluid applicator mounting device 100 through the second pump 78*b* to the fluid reservoir 79. In some examples, fluid may be continuously transported and/or periodically transported in predetermined amounts between the fluid reservoir 79, the common fluid channel 12, and the fluid applicator modules 60*a* , 60*b*, 60*c* , and 60*d*.

Figure 8:
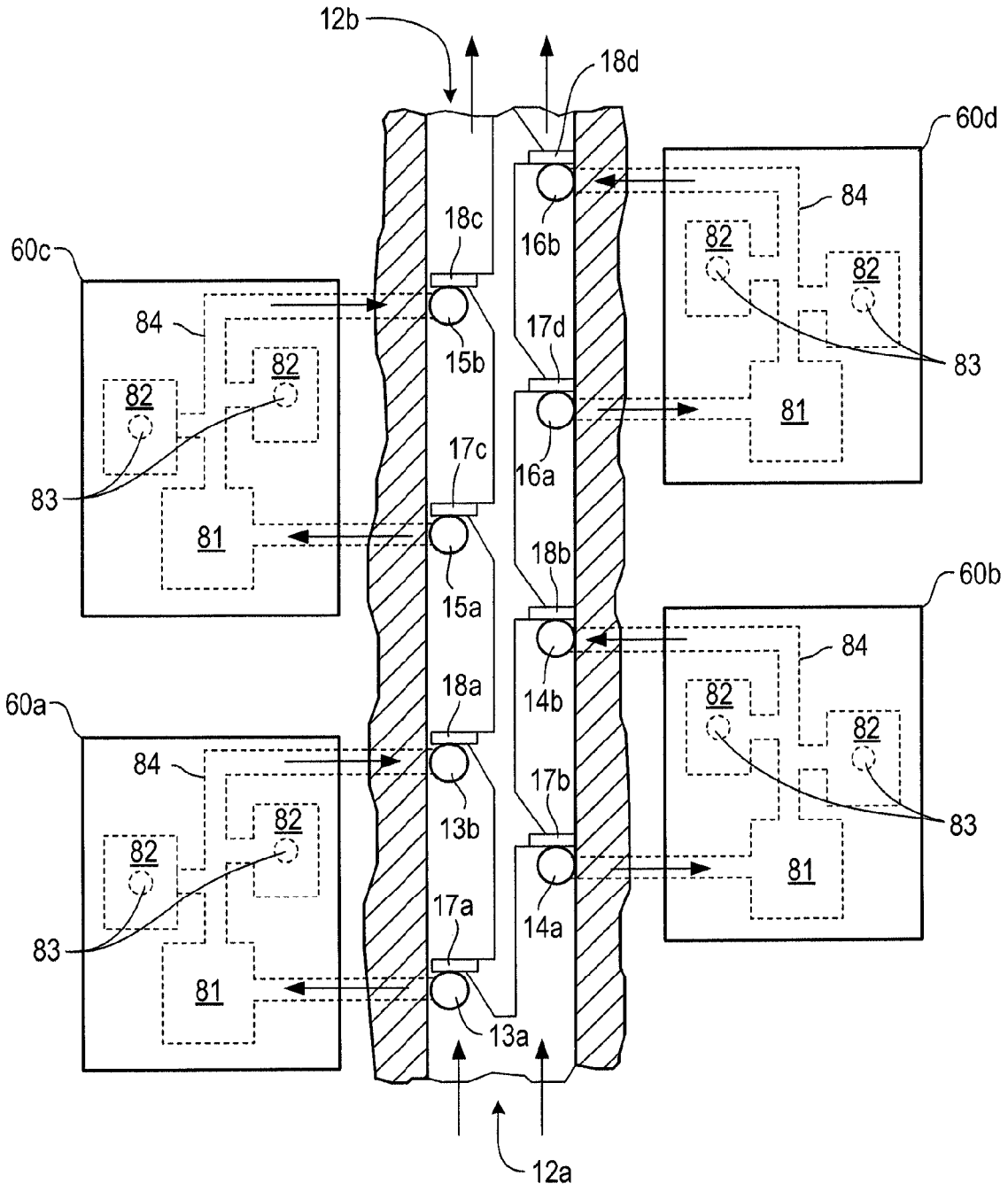
FIG. 8 is a schematic diagram illustrating a portion of the fluid supply system of FIG. 7 according to an example.

FIG. 8 is a schematic diagram illustrating a portion of the fluid supply system of FIG. 7 according to an example. Referring to FIGS. 7-8, in some examples, fluid may circulate between the fluid reservoir 79 and the fluid applicator modules 60*a* , 60*b* , 60*c* , and 60*d* . That is, fluid may flow from the fluid reservoir 79 into the main input port 12*a* of the common fluid channel 12. In the common fluid channel 12, the fluid may be directed by input fin members 17 into corresponding supplemental input ports 17*a* , 17*b* , 17*c* , and 17*d* corresponding to fluid applicator modules 60*a* , 60*b* , 60*c* , and 60*d* . In some examples, inside the respective fluid applicator modules 60*a* , 60*b* , 60*c* , and 60*d* such as printhead modules, a respective supply channel 84 may receive the fluid from the respective supplemental input port 13*a* , 14*a* , 15*a* , and 16*a* to supply the fluid to a fluid chamber 81 and ejection chambers 82 of the respective fluid applicator modules 60*a* , 60*b* , 60*c* , and 60*d* . Fluid from the respective ejection chambers 82 may be selectively ejected there from by an ejection member (not illustrated) through a corresponding nozzle 83 on an object such as media. Each one of the fluid applicator modules 60*a* , 60*b* , 60*c* , and 60*d* may include many ejection chambers 82 and corresponding nozzles 83. Fluid from the respective fluid chamber 81 may replenish the fluid ejected from the respective ejection chambers 82 thereto.

Referring to FIG. 8, in some examples, the fluid not presently ejected from the respective ejection chambers 82 may flow out of the respective fluid applicator modules 60*a* , 60*b* , 60*c* , and 60*d* to be replaced by fluid reentering the respective fluid applicator modules 60*a* , 60*b* , 60*c* , and 60*d*. For example, the non-ejected fluid may flow through the respective supply channel 84 in fluid communication with the respective supplemental output ports 13*b* , 14*b* , 15*b* , and 16*b* and into the common fluid channel 12. In the common fluid channel 12, fluid may be directed away from the corresponding supplemental output ports 13*b* , 14*b* , 15*b* , and 16*b* by respective output fin members 18*a* , 18*b* , 18*c* , and 18*d* . The fluid may continue downstream in the common fluid channel 12 and be directed by respective input fin members 17*c* and 17*d* into and by respective output fin members 18*c* and 18*d* out of fluid applicator modules 60*c* and 60*d* disposed downstream from the previously-supplied fluid applicator modules 60*a* and 60*b* upstream there from in which the fluid exited.

For example, referring to FIG. 8, fluid applicator modules 60*a* and 60*c* may be arranged in a first printhead array in which fluid exiting from fluid applicator module 60*a* may enter into fluid applicator module 60*c* downstream there from. Additionally, fluid applicator modules 60*b* and 60*d* may be arranged in a second printhead array in which fluid exiting from fluid applicator module 60*b* may enter into fluid applicator module 60*d* downstream there from. Subsequently, the fluid may flow out of the main output port 12*b* of the common fluid channel 12 back to the fluid reservoir 79. In some examples, respective fluid applicator modules from the first and second printhead array may be refreshed and/or operated simultaneously.

Figure 9:
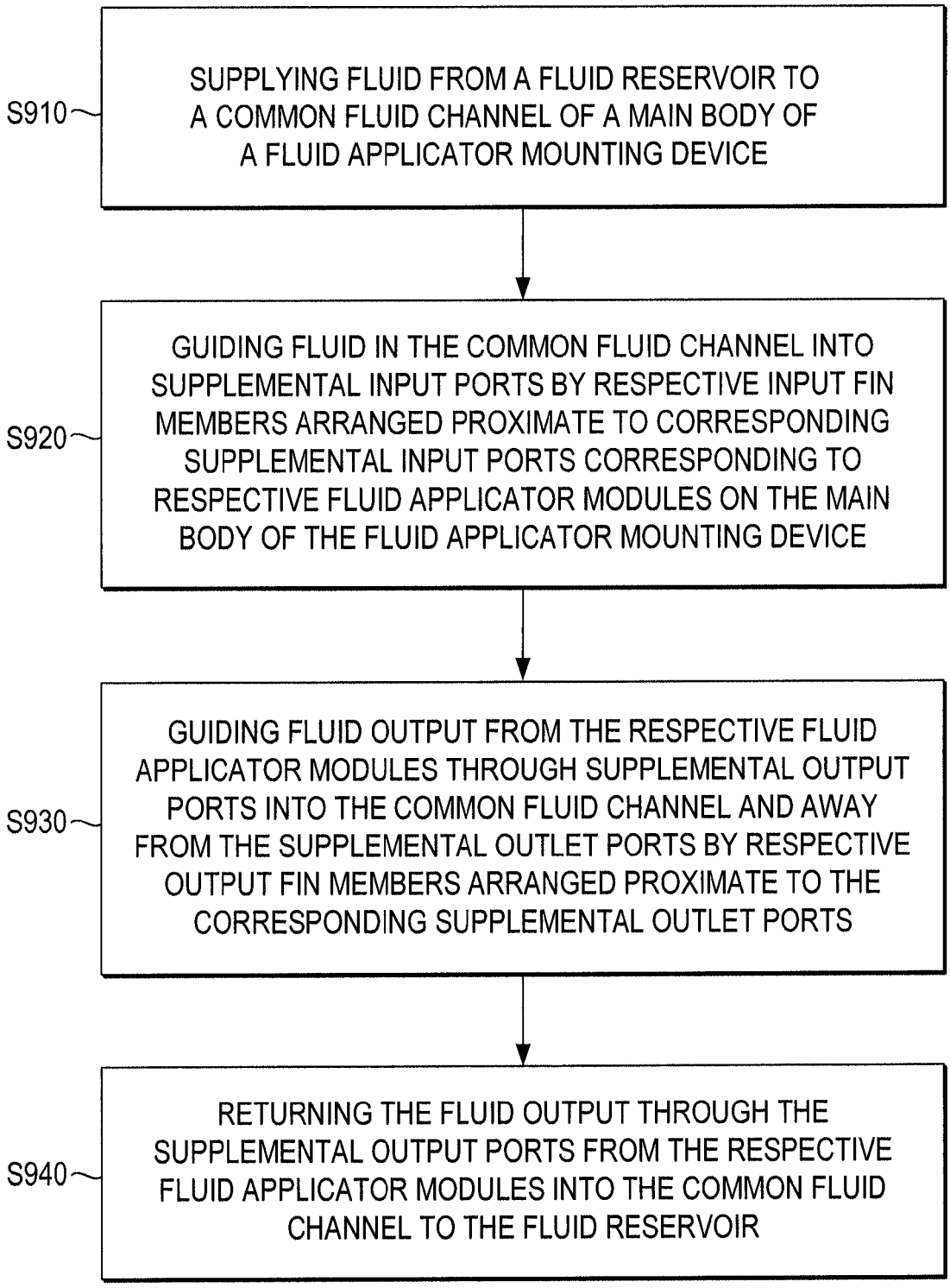
FIG. 9 is a flowchart illustrating a method of supplying fluid to fluid applicator modules according to an example.

FIG. 9 is a flowchart illustrating a method of supplying fluid to fluid applicator modules according to an example. Referring to FIG. 9, in block S910, fluid is supplied from a fluid reservoir to a common fluid channel of a main body of a fluid applicator mounting device. For example, the fluid from the fluid reservoir may be input through a main input port to the common fluid channel. In some examples, the fluid applicator modules may include printhead modules. The printhead modules may be arranged to form a plurality of printhead arrays. In block S920, fluid in the common fluid channel is guided into supplemental input ports by respective input fin members arranged proximate to corresponding supplemental input ports corresponding to respective fluid applicator modules mounted on the main body of the fluid applicator mounting device. In block S930, fluid output from the respective fluid applicator modules through supplemental output ports into the common fluid channel is guided away from the supplemental output ports by respective output fin members arranged proximate to the corresponding supplemental output ports. That is, the fluid may be directed into the common fluid channel to be subsequently output through the main output port from the common fluid channel.

In some examples, the common fluid channel may be formed by walls intersecting with each other such that the common fluid channel has a channel height and a channel width. The input fin members and the output fin members may have a fin height less than the channel height, a fin width less than the channel width, and be arranged substantially perpendicular to at least one of the walls. In block S940, the fluid output through the supplemental output ports from the respective fluid applicator modules into the common fluid channel is returned to the fluid reservoir. For example, the fluid is output from the common fluid channel through the main output port to the fluid reservoir. In some examples, the fluid is continuously transported between the fluid reservoir, the common fluid channel, and the fluid applicator modules. That is, fluid in the fluid applicator modules not presently ejected therefrom may be returned to the fluid reservoir to, subsequently, be transported back to the fluid applicator modules.

It is to be understood that the flowchart of FIG. 9 illustrates architecture, functionality, and/or operation of an example of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 9 illustrates a specific order of execution, the order of execution may differ from that which is depicted. For example, the order of execution of two or more blocks may be scrambled relative to the order illustrated. Also, two or more blocks illustrated in succession in FIG. 9 may be executed concurrently or with partial concurrence. All such variations are within the scope of the present disclosure.

The present disclosure has been described using non-limiting detailed descriptions of examples thereof and is not intended to limit the scope of the present disclosure. It should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the present disclosure and/or claims, "including but not necessarily limited to."

It is noted that some of the above described examples may include structure, acts or details of structures and acts that may not be essential to the present disclosure and are intended to be exemplary. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. A fluid applicator mounting device, comprising:

a main body to removeably receive a fluid applicator module, the main body including a common fluid channel extending therein having a main input port to receive fluid from a fluid reservoir and a main output port to return fluid to the fluid reservoir, and a supplemental port set;

the supplemental port set including a supplemental input port to provide fluid to the fluid applicator module and a supplemental output port to output fluid from the fluid applicator module;

an input fin member disposed inside the common fluid channel and arranged proximate to the supplemental input port to guide fluid to the fluid applicator module; and an output fin member disposed inside the common fluid channel and arranged proximate to the supplemental output port to guide fluid from the fluid applicator module away from the supplemental output port.

2. The fluid applicator mounting device according to claim 1, further comprising:

a fin carrier member coupled to the input fin member and the output fin member extending outward from the fin carrier member to form a single fin unit, wherein the single fin unit is removeably disposed inside the common fluid channel.

3. The fluid applicator mounting device according to claim 1, further comprising:

a plurality of walls intersecting with each other to form the common fluid channel having a channel height and a channel width; and wherein the input fin member and the output fin member have a fin height less than the channel height and a fin width less than the channel width.

4. The fluid applicator mounting device according to claim 3, wherein the input fin member and the output fin member are arranged substantially perpendicular to at least one of the walls.

5. The fluid applicator mounting device according to claim 3, wherein the fluid applicator module is a printhead module.

6. A fluid supply system to supply fluid to fluid applicator modules, the fluid supply system comprising:

the fluid applicator modules to apply fluid onto media; and a fluid applicator mounting device to receive the fluid applicator modules, the fluid applicator mounting device including:

a main body including a common fluid channel therein having a main input port to receive fluid from a fluid reservoir, a main output port to return fluid to the fluid reservoir, and supplemental port sets corresponding to the fluid applicator modules, respectively;

each supplemental port set including a supplemental input port to provide fluid to the corresponding fluid applicator module and a supplemental output port to output fluid from the corresponding fluid applicator module;

input fin members disposed in the common fluid channel, each input fin member is arranged proximate to a corresponding supplemental input port to guide fluid to the respective fluid applicator module; and output fin members disposed in the common fluid channel, each output fin member is arranged proximate to a corresponding supplemental output port to guide fluid from the respective fluid applicator module away from the corresponding supplemental output port.

7. The fluid supply system according to claim 6, wherein the fluid applicator modules comprise printhead modules.

8. The fluid supply system according to claim 7, wherein fluid is continuously transported between the fluid reservoir, the common fluid channel, and the fluid applicator modules.

9. The fluid supply system according to claim 6, further comprising:

a fin carrier member coupled to the input fin members and the output fin members extending outward from the fin carrier member to form a single fin unit, wherein the single fin unit is removeably disposed inside the common fluid channel.

10. The fluid supply system according to claim 6, further comprising:

a plurality of walls intersecting with each other to form the common fluid channel having a channel height and a channel width; and wherein the input fin members and the output fin members have a fin height less than the channel height and a fin width less than the channel width.

11. The fluid system according to claim 10, wherein the input fin members and the output fin members are arranged substantially perpendicular to at least one of the walls.

12. A method of supplying fluid to fluid applicator modules, the method comprising:

supplying fluid from a fluid reservoir to a common fluid channel of a main body of a fluid applicator mounting device;

guiding fluid in the common fluid channel into supplemental input ports by respective input fin members arranged proximate to corresponding supplemental input ports corresponding to respective fluid applicator modules mounted on the main body of the fluid applicator mounting device;

guiding fluid output from the respective fluid applicator modules through supplemental output ports into the common fluid channel and away from the supplemental output ports by respective output fin members arranged proximate to the corresponding supplemental output ports; and returning the fluid output through the supplemental output ports from the respective fluid applicator modules into the common fluid channel to the fluid reservoir.

13. The method according to claim 12, wherein fluid is continuously transported between the fluid reservoir, the common fluid channel, and the fluid applicator modules.

14. The method according to claim 12, wherein:

the common fluid channel is formed by a plurality of walls intersecting with each other such that the common fluid channel has a channel height and a channel width; and the input fin members and the output fin members have a fin height less than the channel height, a fin width less than the channel width, and are arranged substantially perpendicular to the plurality of walls.

15. The method according to claim 12, wherein the fluid applicator modules comprise printhead modules.

16. The fluid applicator mounting device according to claim 1, wherein a fin member is perpendicular to a direction of fluid flow in the common fluid channel.

17. The fluid applicator mounting device according to claim 1, wherein a fin member is circular.

18. The fluid applicator mounting device according to claim 1, wherein an input fin member is downstream of the corresponding supplemental input port and an output fin member is downstream of the corresponding supplemental output port.

19. The fluid applicator mounting device according to claim 1, wherein a fin member is projected from a fin carrier member on an arm, the arm having a dimension smaller than the fin member.

20. The fluid applicator mounting device according to claim 1, wherein an area of a fin member corresponds to an area of the corresponding port.

* * * * *